US007982676B2

(12) United States Patent
Chen et al.

(10) Patent No.: US 7,982,676 B2
(45) Date of Patent: Jul. 19, 2011

(54) ANTENNA STRUCTURE FOR A MOBILE PHONE

(75) Inventors: Chun-Hua Chen, Pa-Te (TW); Chia-Lun Tang, Pa-Te (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 353 days.

(21) Appl. No.: 12/289,486

(22) Filed: Oct. 29, 2008

(65) Prior Publication Data

US 2010/0103068 A1 Apr. 29, 2010

(51) Int. Cl.
*H01Q 1/24* (2006.01)

(52) U.S. Cl. ..... 343/702

(58) Field of Classification Search ..... 343/702, 343/841, 790; 455/89–90
See application file for complete search history.

(56) References Cited

U.S. PATENT DOCUMENTS

| | | | | |
|---|---|---|---|---|
| 4,293,754 | A * | 10/1981 | Komaki | 200/512 |
| 6,095,820 | A * | 8/2000 | Luxon et al. | 343/702 |
| 6,249,256 | B1 * | 6/2001 | Luxon et al. | 343/702 |
| 7,829,810 | B2 * | 11/2010 | Nakajima | 200/333 |

* cited by examiner

*Primary Examiner* — Huedung Mancuso
(74) *Attorney, Agent, or Firm* — Rosenberg, Klein & Lee

(57) ABSTRACT

An antenna structure for a mobile phone to improve its hearing aid compatibility (HAC) character by metal obscuring, the antenna structure mainly is composed of an antenna base board and a copper foil; the antenna base board is provided in a housing of the mobile phone near a sound outputting hole, and a metallic thin layer is made in the housing of the mobile phone in corresponding by position with the antenna base board, the ground surface between the metallic thin layer and a circuit board in the housing of the mobile phone will form an electrically conductive connection. With this structure, distribution of the strength of the electric field of the antenna structure will be improved; thereby the test results for HAC near the sound outputting hole can be evidently improved.

3 Claims, 9 Drawing Sheets
(2 of 9 Drawing Sheet(s) Filed in Color)

Peak E-field in V/m

| | | |
|---|---|---|
| Grid 1<br>**64.2 M3** | Grid 2<br>**40.2 M4** | Grid 3<br>**40.2 M4** |
| Grid 4<br>**63.5 M3** | Grid 5<br>**46.5 M4** | Grid 6<br>**46.4 M4** |
| Grid 7<br>**55.7 M3** | Grid 8<br>**54.2 M3** | Grid 9<br>**52.5 M3** |

Peak H-field in A/m

| | | |
|---|---|---|
| Grid 1<br>**0.170 M3** | Grid 2<br>**0.138 M4** | Grid 3<br>**0.137 M4** |
| Grid 4<br>**0.187 M3** | Grid 5<br>**0.143 M3** | Grid 6<br>**0.140 M3** |
| Grid 7<br>**0.188 M3** | Grid 8<br>**0.143 M3** | Grid 9<br>**0.139 M4** |

Peak E-field in V/m

| | | |
|---|---|---|
| Grid 1<br>**140.1 M2** | Grid 2<br>**124.7 M2** | Grid 3<br>**88.7 M2** |
| Grid 4<br>**122.9 M2** | Grid 5<br>**113.8 M2** | Grid 6<br>**104.0 M2** |
| Grid 7<br>**97.6 M2** | Grid 8<br>**110.2 M2** | Grid 9<br>**108.1 M2** |

Peak H-field in A/m

| | | |
|---|---|---|
| Grid 1<br>**0.347 M2** | Grid 2<br>**0.367 M2** | Grid 3<br>**0.331 M2** |
| Grid 4<br>**0.478 M1** | Grid 5<br>**0.477 M1** | Grid 6<br>**0.341 M2** |
| Grid 7<br>**0.485 M1** | Grid 8<br>**0.483 M1** | Grid 9<br>**0.325 M2** |

ANTENNA STRUCTURE FOR A MOBILE PHONE

BACKGROUND OF THE INVENTION

1. Field of the Invention

The present invention relates to an antenna structure for a mobile phone, and especially to an antenna structure for a mobile phone of which metal is used to obscure around a base board of the antenna to improve the hearing aid compatibility (HAC) character of the antenna structure.

2. Description of the Prior Art

A standardization corporation ANSI (American National Standards Institute) in the U.S.A. stipulated a specification of ANSI C63.19, the FCC (Federal Communication Commission) asked the manufacturers and service agents of mobile phones for the necessity of over 50% satisfaction in meeting the regulation of the limitation of EMI for hearing aids stipulated in ANSI C63.19 on products input to the U.S.A. since Feb. 18, 2008.

The standard in testing stipulated by the specification on the hearing aid compatibility (HAC) in ANSI C63.19 is as below:

a. to use a testing probe for measuring the quantity of the electromagnetic field of 5×5 $cm^2$ and 15 mm above a sound outputting hole of a mobile phone;
b. to divide the tested plane into 9 blocks, each block is separately tested on its electromagnetic field strength;
c. to omit the electromagnetic field strengths of the largest three blocks among the 9 blocks, and to take the block with the largest electromagnetic field strength among the remaining six blocks to define the category of HAC;
d. different categories of HAC are defined by having a difference of value of 5 dB between every two categories, and include the categories of M1, M2, M3, M4 etc. (in which M3 and M4 are categories meeting the standard of stipulation).

Therefore, normally people will observe the HAC categories of electric field and the magnetic field at the same time of an antenna structure, and also omit the field strengths of the largest three blocks, but to take the block with the largest electromagnetic field strength among the remaining six blocks to define the HAC at the present frequency.

In order to meet the specification for the antenna structure under the condition not to lower efficiency, the present invention provides a brand new measure of solution to elevate the category of the antenna structure.

SUMMARY OF THE INVENTION

The present invention provides an antenna structure for a mobile phone to improve its hearing aid compatibility (HAC) character by metal obscuring, the antenna structure mainly is composed of an antenna base board and a copper foil; the antenna base board is provided in a housing of the mobile phone near a sound outputting hole, and a metallic thin layer is made in the housing of the mobile phone in corresponding by position with the antenna base board, the ground surface between the metallic thin layer and a circuit board in the housing of the mobile phone will form an electrically conductive connection. With this structure, distribution of the strength of the electric field of the antenna structure will be improved; thereby HAC near the sound outputting hole in testing can be evidently improved.

The metallic thin layer of the present invention can be made on the surface of the housing of the mobile phone, and also can be shaped and embedded in the housing; otherwise, it can be made by copper covering.

The present invention will be apparent in its structure and functions after reading the detailed description of the preferred embodiment thereof in reference to the accompanying drawings.

BRIEF DESCRIPTION OF THE DRAWINGS

The file of this patent contains at least one photograph executed in color. Copies of the patent with color drawings will be provided by the Patent and Trademark Office upon request and payment of the necessary fee.

DETAILED DESCRIPTION OF THE PREFERRED EMBODIMENT

Figure 7:
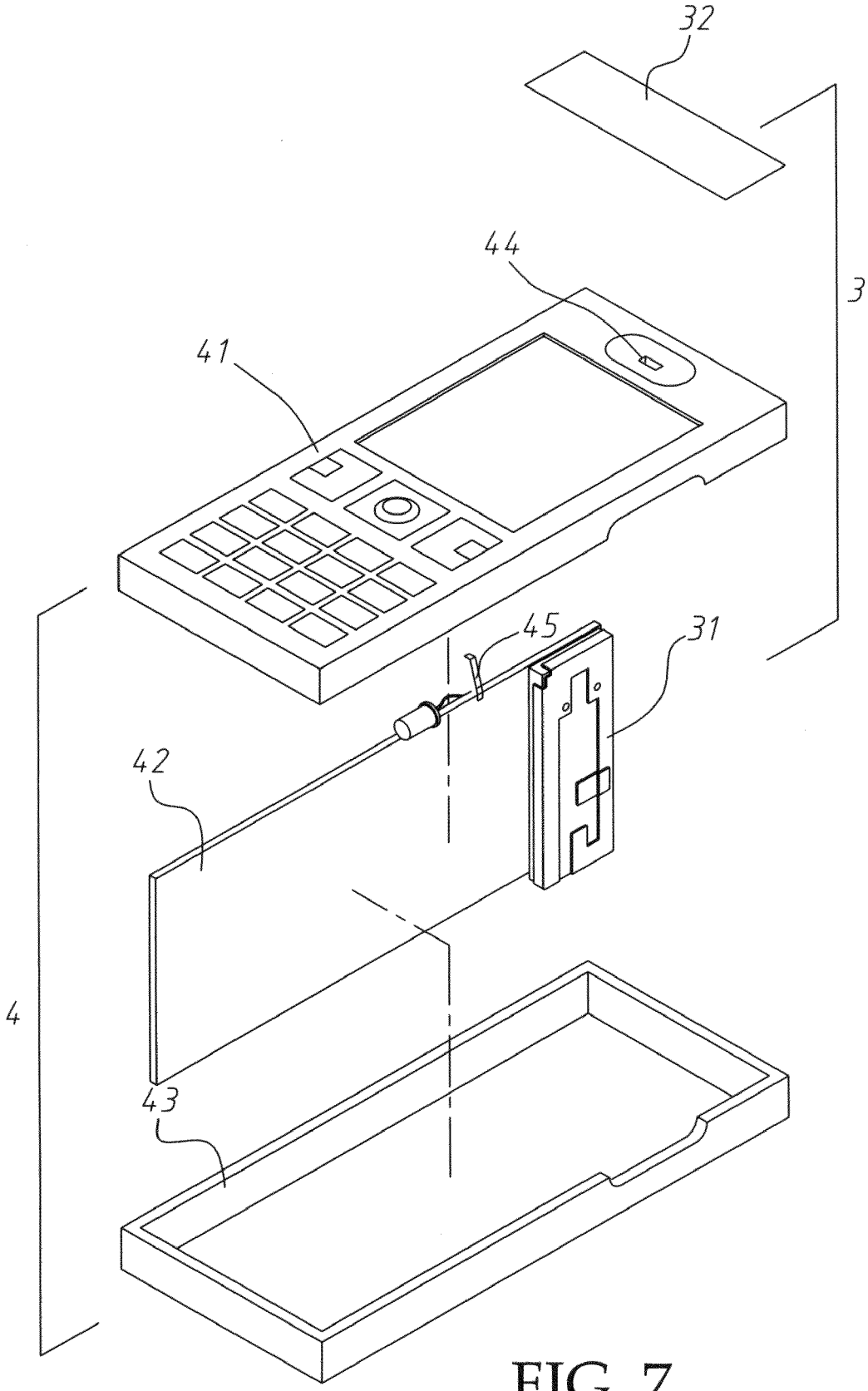
FIG. 7 is an anatomic perspective view of the present invention showing a metallic thin layer is made on the housing of a mobile phone in which the metallic thin layer has not been attached.
Figure 8:
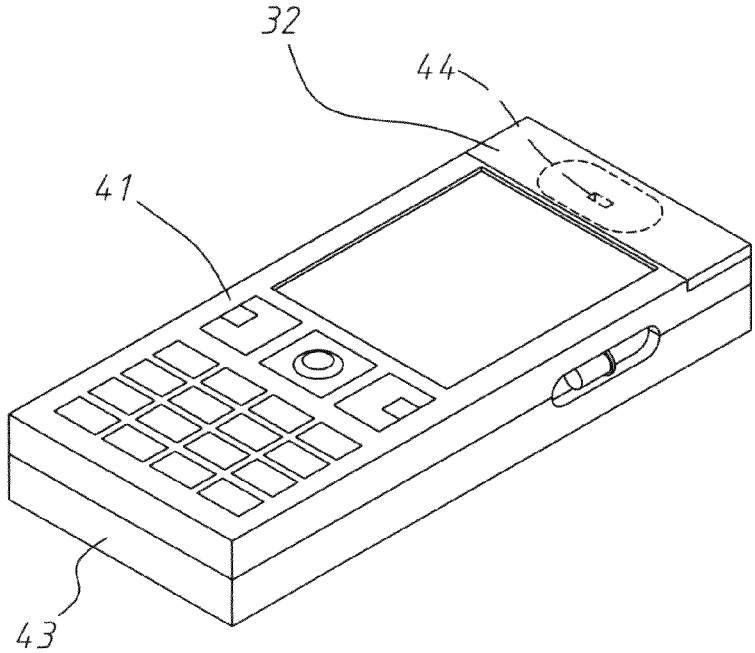
FIG. 8 is a perspective view of FIG. 7 after assembling.
Figure 9:
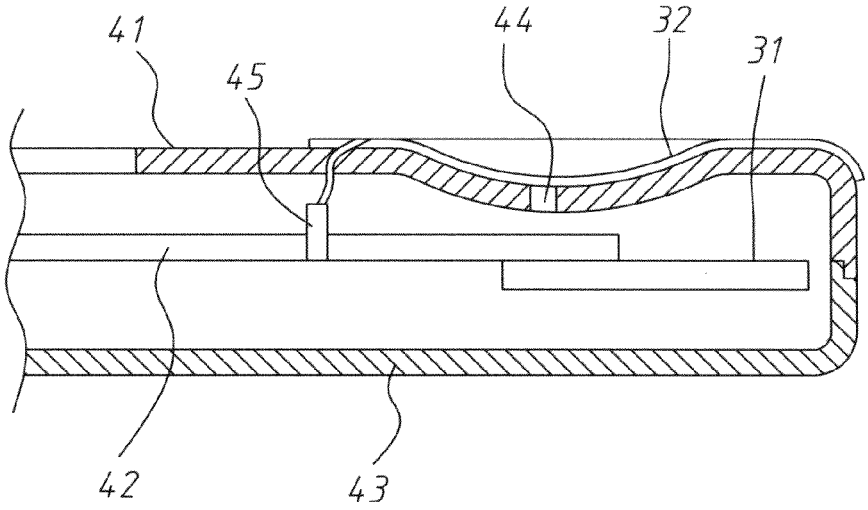
FIG. 9 is a partial sectional view taken from FIG. 8.

Referring to FIGS. 7-9, an antenna structure 3 provided in the present invention is assembled in a mobile phone 4 having a sound outputting hole 44, the antenna structure 3 is connected with a circuit board 42 (having a ground surface) in a housing (composed of an upper housing part 41 and a lower housing part 43) of the mobile phone 4 for wireless signal transmitting. The antenna structure 3 comprises mainly an antenna base board 31 and a metallic thin layer 32.

The antenna base board 31 is provided in the housing composed of the upper housing part 41 and the lower housing part 43 of the mobile phone 4 and near the sound outputting hole 44. The metallic thin layer 32 is shaped and embedded in the housing of the mobile phone 4 in corresponding by position with the antenna base board 31 to obscure around the latter, and can be or can be not electrically connected with the ground surface of the circuit board 42; as is shown in the drawing, when being grounded, it is connected with a grounding line 45 extending out of the circuit board 42.

The present invention has the antenna base board 31 obscured by the metallic thin layer 32 therearound, thereby distribution of the strength of the electric field of the antenna structure near the sound outputting hole 44 will be improved as compared with the case without the metallic thin layer 32 no matter the metallic thin layer 32 is or is not connected with a ground surface; thereby the HAC character can be evidently improved.

And more, in the embodiment of the present invention, taking the length and the width of the metallic thin layer 32 to be 60 mm and 40 mm respectively, the test results for HAC for the metallic thin layer 32 being and being not connected with a ground surface using the operation frequency range of DCS512 (1710 MHZ) and DCS700 (1747 MHZ) respectively are shown in the table below:

| Channel | Name | Time avg. of electric field (V/m) | Category | Efficiency |
|---|---|---|---|---|
| 512 | grounded | 78.1 | M3 | 83.37% |
| 700 | grounded | 77.7 | M3 | 72.2% |
| 512 | not grounded | 86.3 | M2 | 77.48% |
| 700 | not grounded | 89.9 | M2 | 67.17% |

Note:
DCS512 (1710 MHZ) and DCS700 (1747 MHZ)

We can see from the above table that the metallic thin layer 32 can elevate the category of HAC whether being or being not connected with a ground surface.

Figure 10:
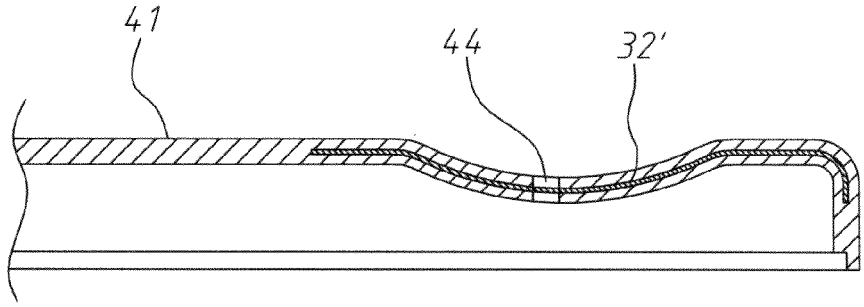
FIG. 10 is a schematic sectional view showing the metallic thin layer is shaped and embedded in the housing of the mobile phone.

Referring to FIG. 10, this is another embodiment of the present invention, a metallic thin layer 32' in the antenna structure 3 of the present invention can be shaped and embedded in the upper housing part 41 of the mobile phone (such as by injection enveloping) to obscure the antenna base board 31 near the sound outputting hole 44.

Figure 1:
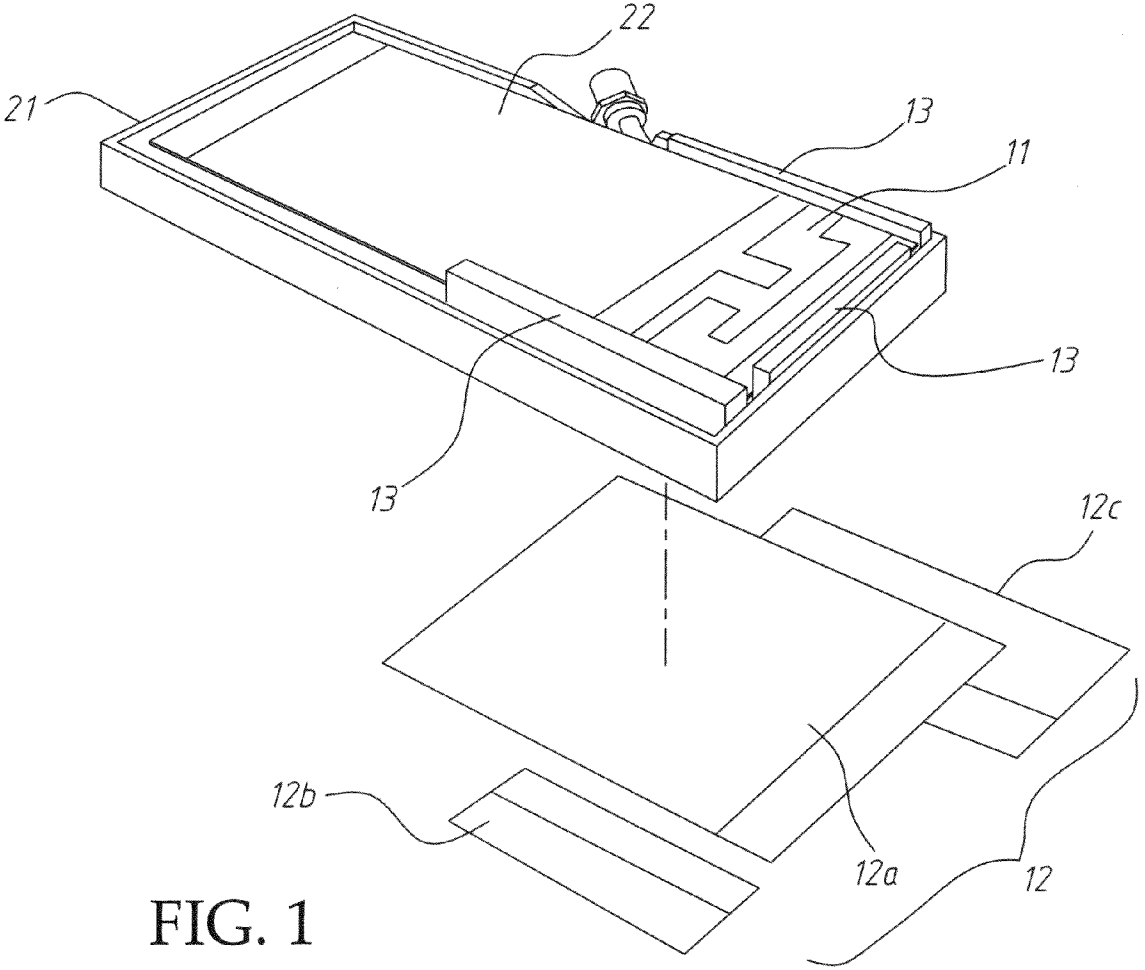
FIG. 1 is an anatomic perspective view of the present invention showing making of a metallic thin layer from a copper foil, in which the copper foil has not been stuck.
Figure 2:
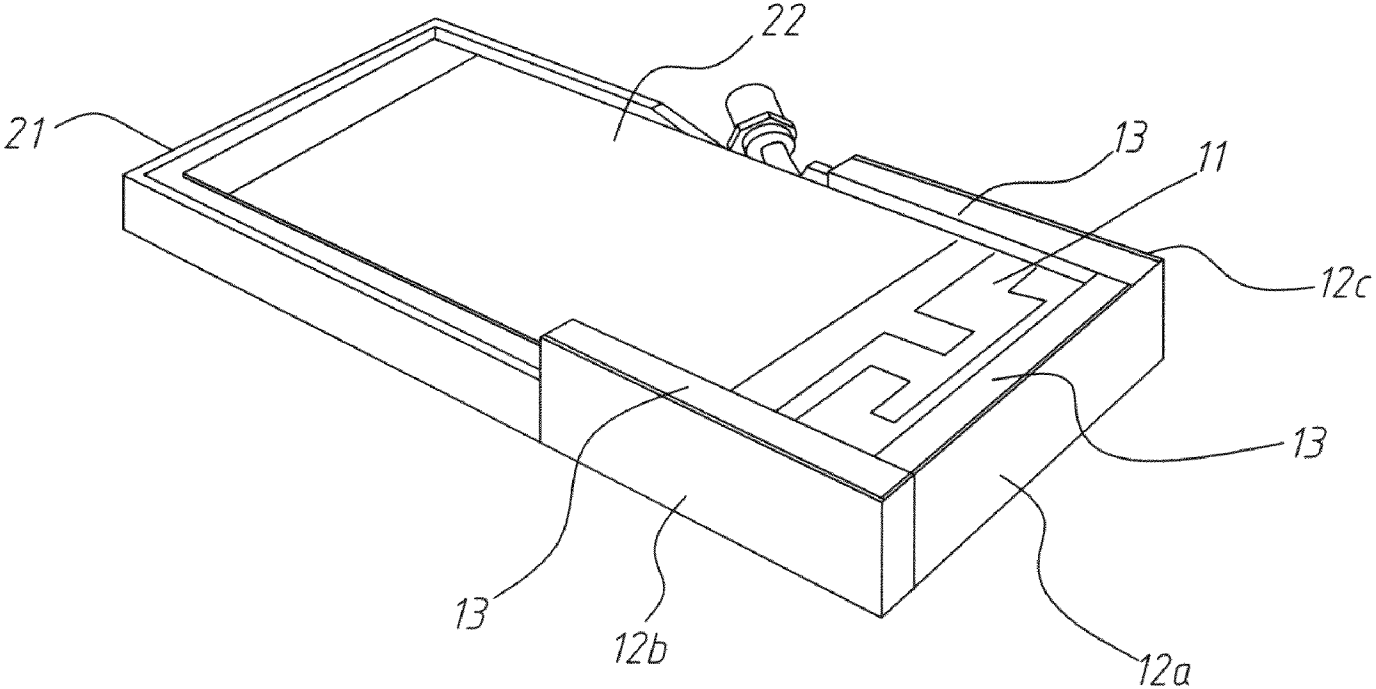
FIG. 2 is a perspective view of the present invention after assembling, in which the copper foil has been stuck on the housing of a mobile phone.
Figure 3:
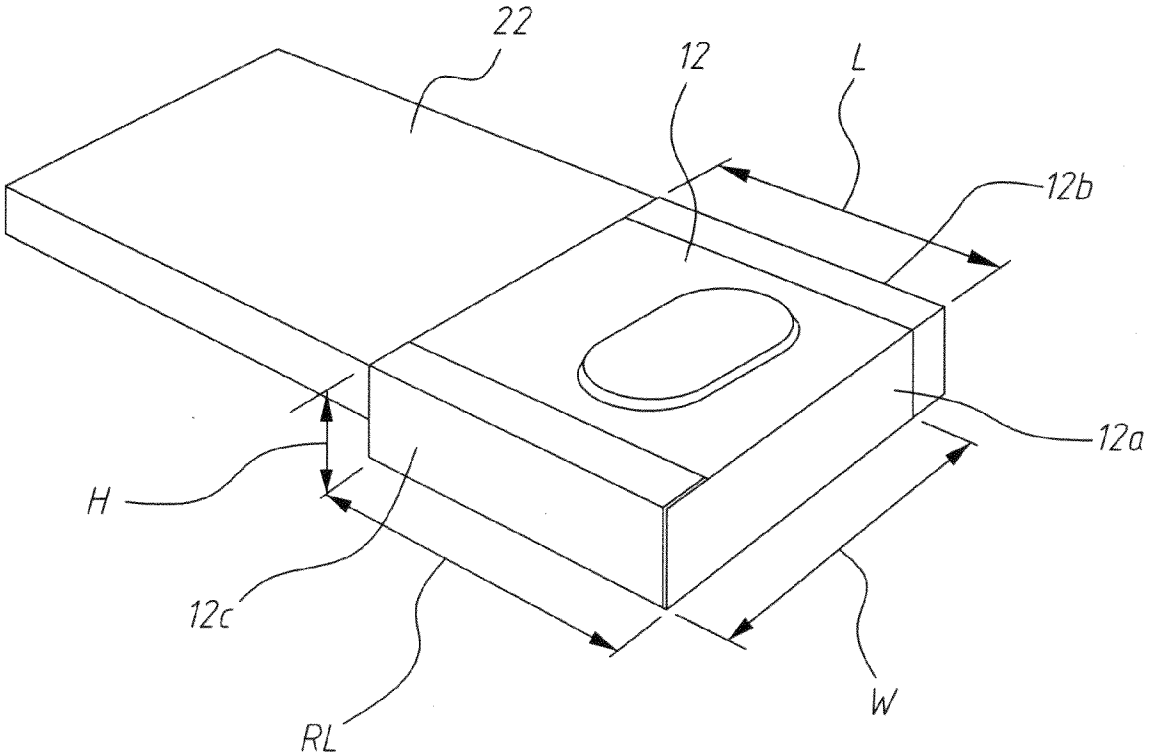
FIG. 3 is a perspective view of the present invention seeing in another direction.

And more, a metallic thin layer of the present invention can be made from a covering copper foil. As shown in FIGS. 1-3, the antenna structure is provided in the mobile phone to connect with an electric circuit board 22 having a ground surface in a housing 21 of a mobile phone for wireless signal transmitting. The antenna structure of the present invention mainly comprises an antenna base board 11 and a copper foil 12.

Figure 4:
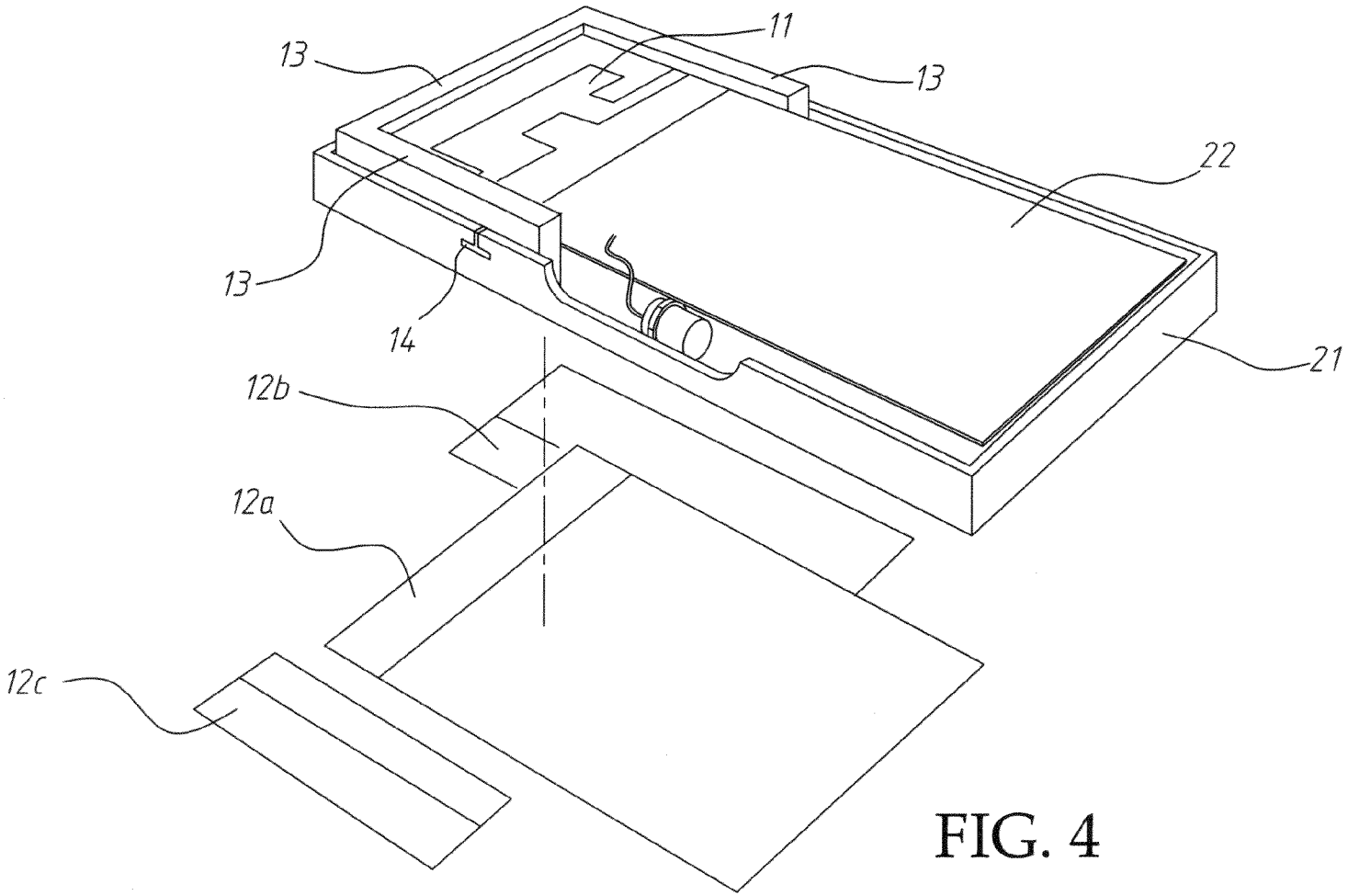
FIG. 4 is a schematic perspective view of the present invention seeing in a further direction.

The antenna base board 11 of the present invention is provided in the housing 21 of the mobile phone near a sound outputting hole, and there are insulating pads 13 provided on three edges inside of the housing 21 of the mobile phone surrounding the antenna base board 11. The copper foil 12 envelops the antenna base board 11 from outside of the housing 21 at an area where the antenna base board 11 is, and the copper foil 12 is composed of a main copper foil 12*a* and two wing copper foils 12*b*, 12*c* for enveloping the housing 21 of the mobile phone with their edges folded upwards toward the vertical outer surfaces of the insulating pads 13 to form a kind of inverse "U" shaped enveloping, the ground surfaces of the copper foil 12 and the electric circuit board 22 form electric conductive connection; Referring to FIG. 4, the electric circuit board 22 has a grounding line 14 extending out to the wing copper foil 12*c*, thereby after enveloping, the copper foil 12 contacts the grounding line 14 to form electric conductive connection with the ground.

Referring to FIG. 3 showing an embodiment of copper foil enveloping of the present invention, wherein a length L, a right side length RL, a width W and a height H that the copper foil 12 surrounds by enveloping the antenna base board 11 are respectively 40 mm, 35 mm, 60 mm and 13.3 mm. A table of HAC tests taking the embodiment of the present invention and an empty circuit board for operation under different frequency ranges is obtained as shown below:

| Channel | Name | Time avg. of electric field (V/m) | Category | Efficiency |
|---|---|---|---|---|
| 512 | Copper foil enveloping | 54.2 | M3 | 53.06% |
| 38 | Copper foil enveloping | 162.9 | M3 | 60.24% |
| 512 | Empty circuit board | 113.8 | M2 | 58.36% |
| 38 | Empty circuit board | 186.3 | M2 | 48.74% |

Note:
PCS512 (1850 MHZ) and EGSM38 (848 MHZ)

We can see from the above table that, when the present invention is operated under a high frequency range (1850 MHZ), as compared with the empty circuit board without being enveloped with a copper foil, it has a close efficiency to that of the latter, but HAC of the present invention is much improved.

Figure 5:
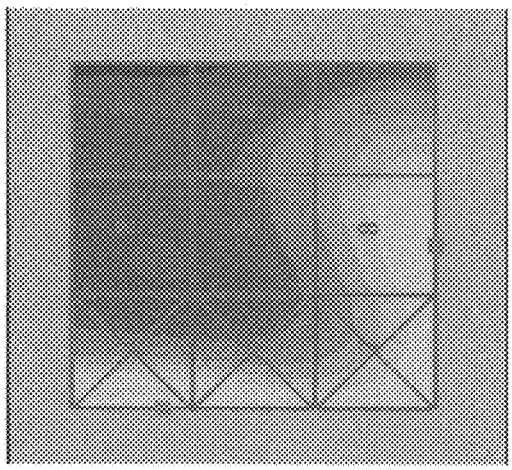
FIG. 5 is a chart showing a test result of the present invention for a high frequency range (1850 MHZ) HAC.
Figure 5:
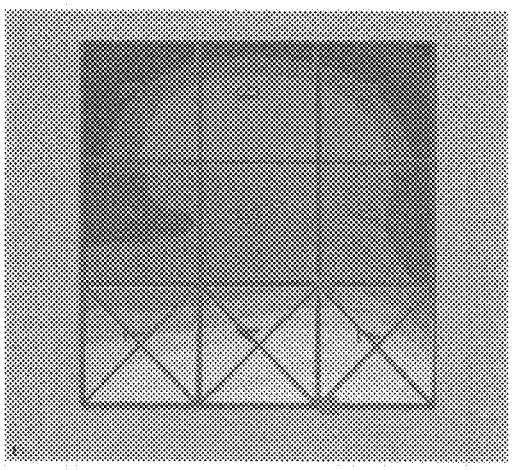
Figure 6:
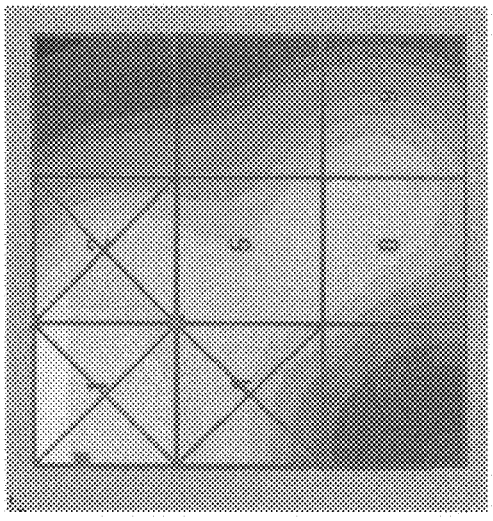
FIG. 6 is a chart showing a test result of the present invention for the high frequency range (1850 MHZ) HAC under the condition of having no copper foil covered an empty electric circuit board.
Figure 6:
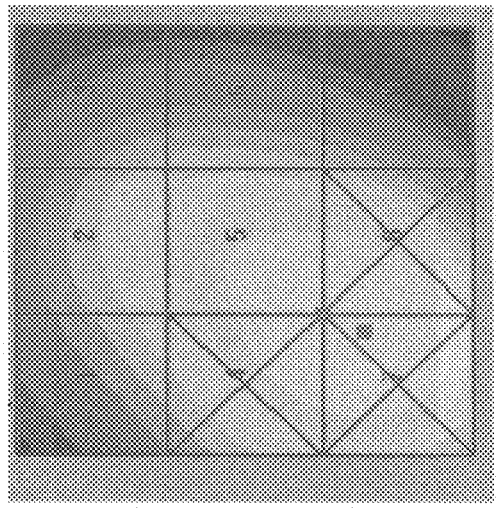

Moreover, FIG. 5 shows a test result for this embodiment enveloped with a copper foil of the present invention for a high frequency range (1850 MHZ) HAC; while FIG. 6 shows a test result for the embodiment without being enveloped with a copper foil also for a high frequency range (1850 MHZ) HAC.

FIGS. 5 and 6 present some 9 grid charts for comparing strengths of E-fields; the present invention is enveloped with a copper foil, as compared with the empty circuit board, HAC can be elevated from M2 (being failed to meet the regulation stipulated in ANSI C63.19) to M3 (meeting the regulation stipulated in ANSI C63.19).

Evidently, after the antenna base board 11 is surrounded by enveloping of the copper foil 12 and is connected with the ground surface, its strength of E-field is larger than that of the empty circuit board, thereby the hearing aid compatibility (HAC) character can be improved evidently.

In conclusion, the bran new structure of the present invention as stated above meets the element requirement for a patent. While the embodiment given is only for illustrating preferred embodiments of the present invention, and not for giving any limitation to the scope of the present invention; it will be apparent to those skilled in this art that various modifications or changes without departing from the spirit of this invention shall also fall within the scope of the appended claims.

The invention claimed is:

1. An antenna structure for a mobile phone having an improved hearing aid compatibility (HAC) character, said mobile phone having a sound output hole, said antenna structure being provided in said mobile phone and being connected with a circuit board having a ground surface in a housing of said mobile phone for wireless signal transmission, said antenna structure comprising:

an antenna base board provided in said housing of said mobile phone near said sound output hole;

three insulating pads surrounding three edges inside of said housing of said mobile phone a metallic thin layer being a copper foil which envelops said antenna base board from outside of said housing of said mobile phone at a location disposed in correspondence with said antenna base board to be in spaced relationship with said antenna base board, said copper foil being composed of a main copper foil and two wing copper foils for enveloping said housing of said mobile phone with respective edges thereof folded upwardly toward vertical outer surfaces of said insulating pads to form a kind of inverse U-shaped envelopment, said circuit board having a grounding line extending out to one of said wing copper foils, in order that said copper foil contacts said grounding line to form an electric conductive connection with said ground surface of said circuit board.

2. The antenna structure for a mobile phone as defined in claim 1, wherein said metallic thin layer forms an electrically conductive connection with said circuit board having said ground surface.

3. The antenna structure for a mobile phone as defined in claim 1, wherein a length L, a right side length RL, a width W and a height H of said copper foil positioned on said housing are respectively 40 mm, 35 mm, 60 mm and 13.3 mm.

* * * * *